US011473744B1

(12) United States Patent
Liu

(10) Patent No.: US 11,473,744 B1
(45) Date of Patent: Oct. 18, 2022

(54) PANEL LAMP

(71) Applicant: BRAVOLED INDUSTRAIL COMPANY LIMITED, Shenz (CN)

(72) Inventor: Ziang Liu, Shenzhen (CN)

( * ) Notice: Subject to any disclaimer, the term of this patent is extended or adjusted under 35 U.S.C. 154(b) by 0 days.

(21) Appl. No.: 17/316,536

(22) Filed: May 10, 2021

(51) Int. Cl.

| | |
|---|---|
| ***F21S 8/04*** | (2006.01) |
| ***F21V 19/00*** | (2006.01) |
| ***F21V 17/10*** | (2006.01) |
| ***F21Y 115/10*** | (2016.01) |

(52) U.S. Cl.
CPC ..... *F21S 8/043* (2013.01); *F21V 17/104* (2013.01); *F21V 19/0045* (2013.01); *F21Y 2115/10* (2016.08)

(58) Field of Classification Search
CPC ..... G02B 6/0086; F21V 21/03; F21V 21/047; F21V 15/01; F21Y 2105/00; F21S 8/03; F21S 8/04
See application file for complete search history.

(56) References Cited

U.S. PATENT DOCUMENTS

2020/0080709 A1* 3/2020 Boulanger ..... F21S 8/03
2021/0156533 A1* 5/2021 Bai ..... F21V 21/047

* cited by examiner

*Primary Examiner* — William J Carter

(57) ABSTRACT

A panel lamp includes a bottom case, a lamp cover, a lighting assembly arranged between the bottom case and the lamp cover, at least two bendable suspending assemblies arranged at two opposite sides of the bottom case. The bottom case defines a mounting groove, and an edge of the lamp cover is configured to be received into the mounting groove. The suspending assemblies are configured to hang the bottom case onto an overhead structure.

19 Claims, 11 Drawing Sheets

PANEL LAMP

FIELD OF THE INVENTION

The subject matter herein relates generally to lamps, and more particularly to a panel lamp.

BACKGROUND OF THE INVENTION

Panel lamps are widely used in indoor lighting, which can be installed onto an overhead structure such as a ceiling. It is one of the important elements for interior decoration. Existing panel lamps are usually composed of an aluminum frame, a diffusion plate, a light source assembly, a pad and a back plate. Because its outer frame is made of aluminum alloy by anodizing, and the light source is usually LED, the design of the whole lamp is beautiful, simple and luxurious, which not only has good lighting effect, but also brings people aesthetics feeling.

However, a structure for mounting the existing panel lamp onto the top structure is complicated and it's difficult to mount the existing panel lamp onto the top structure. In general, when mounting a panel lamp onto the top structure, it is needed to connect wires between the top structure and the panel lamp and mount the panel lamp onto the fixture. It is difficult and time-consuming due to a large volume and weight of the panel lamp.

SUMMARY OF THE INVENTION

The present disclosure provides a panel lamp which is simple in structure and easy to be mounted onto a fixture.

A panel lamp includes a bottom case, a lamp cover, a lighting assembly arranged between the bottom case and the lamp cover, at least two bendable suspending assemblies arranged at two opposite sides of the bottom case. The bottom case defines a mounting groove, and an edge of the lamp cover is configured to be received into the mounting groove. The suspending assemblies are configured to hang the bottom case onto an overhead structure.

In at least one embodiment, a flange extends from a sidewall of the bottom case and the mounting groove is defined in the flange, the lamp cover is capable of being pushed into the mounting groove under an external force applied thereon.

In at least one embodiment, a turned edge extends from the sidewall of the bottom case and a height of the turned edge is not less than that of the flange.

In at least one embodiment, the suspending assembly includes a first connecting plate connected to the bottom case, a second connecting plate connected to the first connecting plate, a third connecting plate rotatably connected to the second connecting plate, and a hook connected to the third connecting plate.

In at least one embodiment, the suspending assembly is integrally formed by bendable metal.

In at least one embodiment, the suspending assembly is capable of being switched between a suspending state where the suspending assembly is capable of being suspended onto the overhead structure and a folding state where the suspending assembly is attached to a sidewall of the bottom case.

In at least one embodiment, the second connecting plate is substantially perpendicular to the first connecting plate, the hook is substantially perpendicular to the third connecting plate, and the third connecting plate is rotatably connected to the second connecting plate, when the third connecting plate is rotated to be in the same plane with the second connecting plate the suspending assembly is in the suspending state, and when the third connecting plate is rotated to be substantially perpendicular to the second connecting plate the suspending assembly is in the folded state.

In at least one embodiment, a portion of the first connecting plate where the second connecting plate is connected to, a portion of the second connecting plate where the third connecting plate is connected to, and a portion of the third connecting plate where the hook is connected to are bendable.

In at least one embodiment, a portion of the first connecting plate where the second connecting plate is connected to, a portion of the second connecting plate where the third connecting plate is connected to, and a portion of the third connecting plate where the hook is connected to are in a hollowed-out structure.

In at least one embodiment, the third connecting plate defines a threading hole which is configured to allow a safe rope to pass therethrough.

In at least one embodiment, the number of the at least two suspending assemblies is four, four suspending assemblies are symmetrically arranged at two opposite sides of the bottom case.

In at least one embodiment, the bottom case defines a first through hole at a backwall of the bottom case, the first through hole is configured to allow wires connecting the lighting assembly to pass therethrough to connect a power source in the top structure.

In at least one embodiment, a cover plate is moveably connected to the bottom case and configured to cover the first through hole, the cover plate defines a second through hole which is configured to allow the wires connecting the lighting assembly to pass therethrough to connect the power source in the top structure, a size of the second through hole is less than that of the first through hole.

In at least one embodiment, the panel lamp further includes a slot assembly defined at a back side of the bottom case and a mounting bracket, the slot assembly includes a first slot, a second slot communicating with the first slot, and a third slot near the second slot, the mounting bracket includes at least one mounting plate, two mounting parts are arranged at two opposite sides of each mounting plate and each mounting part is provided with a clamping member, the mounting part is capable of moving along the first slot and moving from the first slot to the second slot until the clamping member enters the third slot.

In at least one embodiment, the number of the at least one mounting plate is two, the mounting bracket further includes two connecting plates, and two connecting plates together with the two mounting plates to form a rectangular frame.

In at least one embodiment, a fixing plate is connected between the two connecting plates, the fixing plate defines a third through hole which is configured to allow the wires connecting the lighting assembly to pass therethrough to connect a power source in the top structure.

In at least one embodiment, the panel lamp further includes a suspending structure, one end of the suspending structure is rotatably connected to the bottom case, and the other end of the suspending structure is capable of being hung from the mounting bracket.

In at least one embodiment, the mounting bracket includes at least one guiding plate which extends from one of the two mounting plates towards the fixing plate, the suspending structure is configured to move along the guiding plate, the guiding plate is provided with a blocking part which is configured, to prevent the suspending structure from moving away from the guiding plate.

In at least one embodiment, the suspending structure is U-shaped, two distal ends of the suspending structure are connected to the bottom case through two fastening elements respectively.

In at least one embodiment, each fastening element includes a fastening part and two fixing part arranged at two opposite ends of the fastening part, the fixing parts are connected to the bottom case, the fastening part defines a limiting hole which allows the distal ends of the suspending structure to pass therethrough.

The bottom case defines a mounting groove, and an edge of the lamp cover is configured to be received into the mounting groove, a frame-less panel lamp is thus achieved. The frameless panel lamp is beautiful and a connection between the lamp cover and the bottom case is stable and reliable. At least two bendable suspending assemblies are arranged at two opposite sides of the bottom case and configured to hang the bottom case onto a top structure. Therefore, the panel lamp can be mounted to any suitable top structure which can engaged with the suspending assemblies. The suspending assemblies is universal, which makes the panel lamp more applicable to all kinds of environments. The panel lamp is simple structured and easy to mount. Only one person himself can complete mounting the panel lamp onto the top structure, and a connection between the panel lamp and the top structure is safe and reliable. Therefore, the panel lamp can solve the problem of difficult installation, as well as reducing the installation cost.

BRIEF DESCRIPTIONS OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE ILLUSTRATED EMBODIMENT

Figure 1:
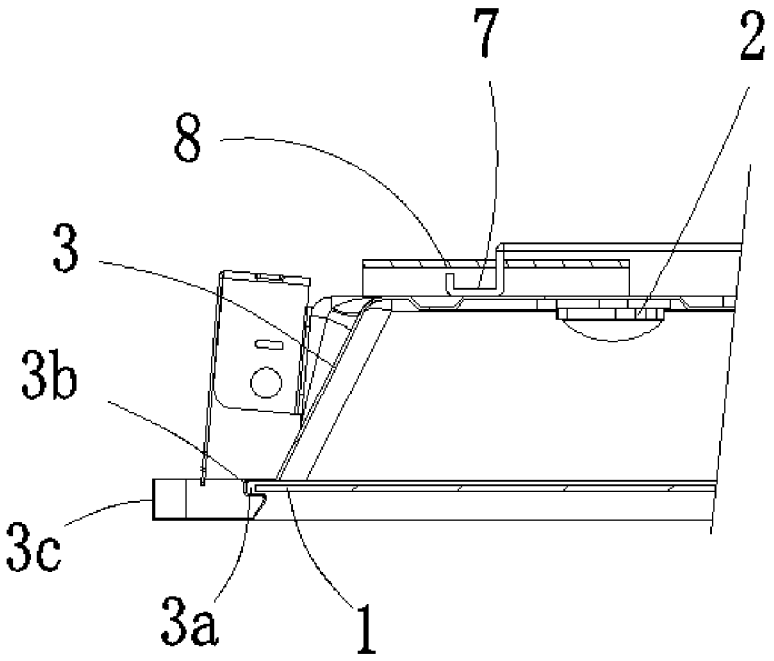
FIG. 1 is a partial cross-sectional view of a panel lamp in a first state according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the invention, "a plurality of" means two or more, unless otherwise specifically defined.

Figure 2:
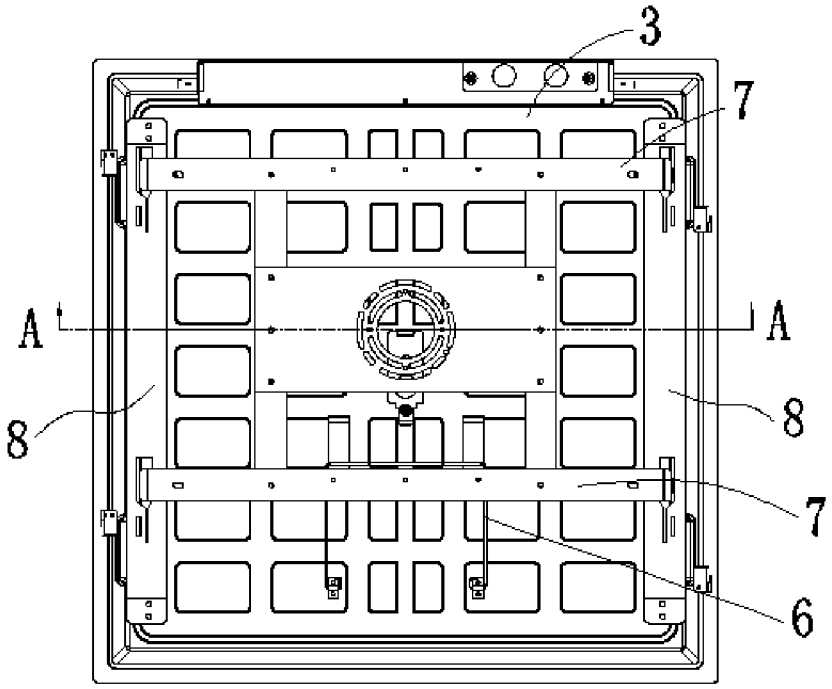
FIG. 2 is a top view of the panel lamp of FIG. 1 in the first state in according to an embodiment of the present disclosure.
Figure 3:
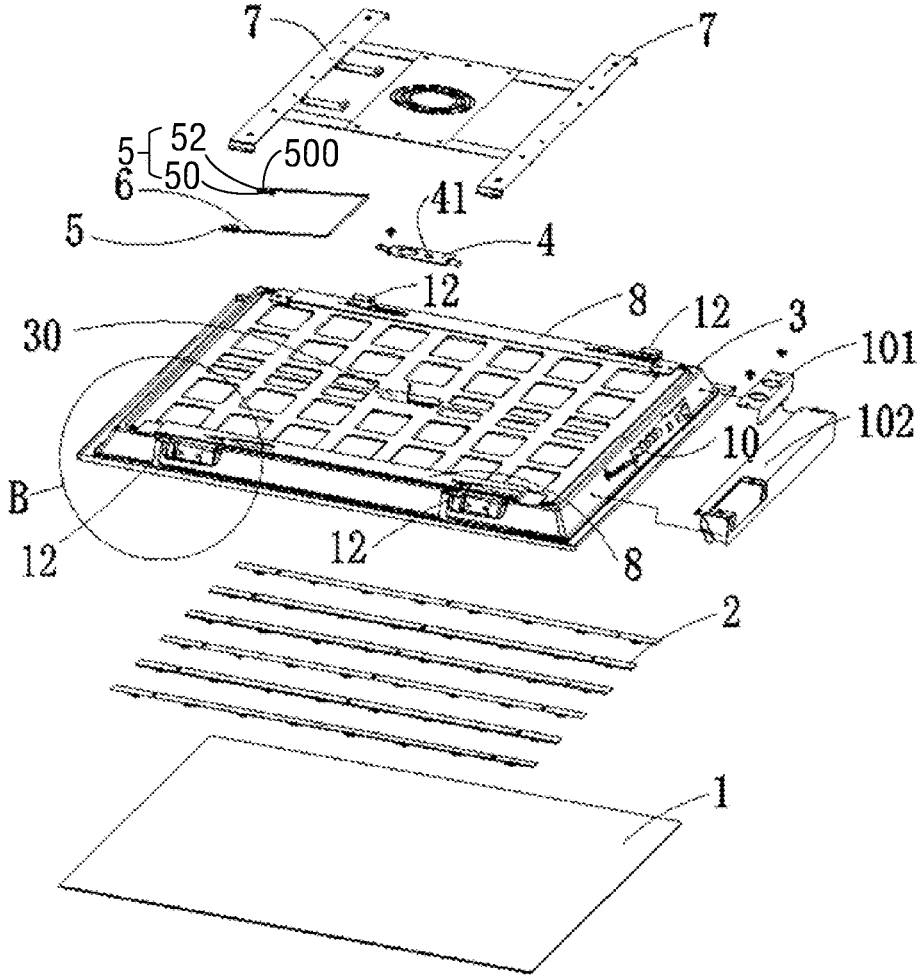
FIG. 3 is an exploded view of the panel lamp of FIG. 2 in accordance with an embodiment of the present disclosure.

Referring to FIGS. 1-3, an embodiment of the present disclosure provides a panel lamp including a lamp cover 1, a lighting assembly 2, and a bottom case 3. The lamp cover 1 can be mounted on the bottom case 3 to form a receiving space for receiving the lighting assembly 2. The lamp cover 1 can be a light-transmitting plate. The bottom case 3 defines an opening which can be covered by the lamp cover 1. The bottom case 3 can be integrally formed. In at least one embodiment, the bottom case 3 defines a mounting groove 3*a* near the opening. The lamp cover 1 can be engaged into the mounting groove 3*a* to mount the lamp cover 1 onto the bottom case 3. The lamp cover 1 can be easily pushed to be mounted onto the bottom case 3 or separated from the bottom case 3 only by hand without any mounting tools or fastening elements. In at least one embodiment, referring to FIG. 2, the bottom case 3 forms a flange 3*b* and the mounting groove 3*a* is arranged inside the flange 3*b*. The lamp cover 1 can be pushed into the mounting groove 3*a* to achieve a frameless structure of the panel lamp. The panel lamp is simple as a whole and beautiful. In addition, a connection between the lamp cover 1 and the bottom case 3 is stable and not easy to lose or slide off.

In at least one embodiment, a turned edge 3*c* bends from an end of a sidewall of the bottom case 3 to make the end of the sidewall of the bottom case 3 smooth and prevent a user from being hurt by sharp edges. A height (a size along a direction perpendicular a plane where the lamp cover is arranged) of the turned edge 3*c* is not less than that of the flange 3*b*. When the panel lamp is mounted onto a top structure (a structure that is high above the ground, such as a ceiling or a top of a tent, the flange 3*b* can be hidden by the turned edge 3*c*, which can further improve aesthetics.

In at least one embodiment, a power device 10 is arranged at the sidewall of the bottom case 3. The power device 10 can be covered by a power case 102 which is connected to the bottom case 3. The power case 102 defines an opening, and a power cover 101 is detachably connected to the power case 102 to cover the opening.

In at least one embodiment, four deformable suspending assemblies 12 are symmetrically arranged on two opposite sides of the bottom case 3 to allow the panel lamp to be hung onto the top structure. Each suspending assembly 12 includes a first connecting plate 121, a second connecting plate 122, a third connecting plate 123, and a hook 124. The first connecting plate 121 is connected to the bottom case 3. In at least one embodiment, the first connecting plate 121 can be connected to the bottom case 3 with fastening elements like screws.

In at least one embodiment, the suspending assembly 12 is integrally formed from extendable metal. The integrally structure is easy to manufacture and easy to use. A portion of the first connecting plate 121 where the second connecting plate 122 is connected to, a portion of the second connecting plate 122 where the third connecting plate 123 is connected to, and a portion of the third connecting plate 124 where the hook 124 is connected to are bendable. In at least one embodiment, the portion of the first connecting plate 121 where the second connecting plate 122 is connected to, the portion of the second connecting plate 122 where the third connecting plate 123 is connected to, and the portion of the third connecting plate 124 where the hook 124 is connected to are in a hollowed-out structure. The hollowed-out structure is easy to bend and thus convenient for use.

Figure 4:
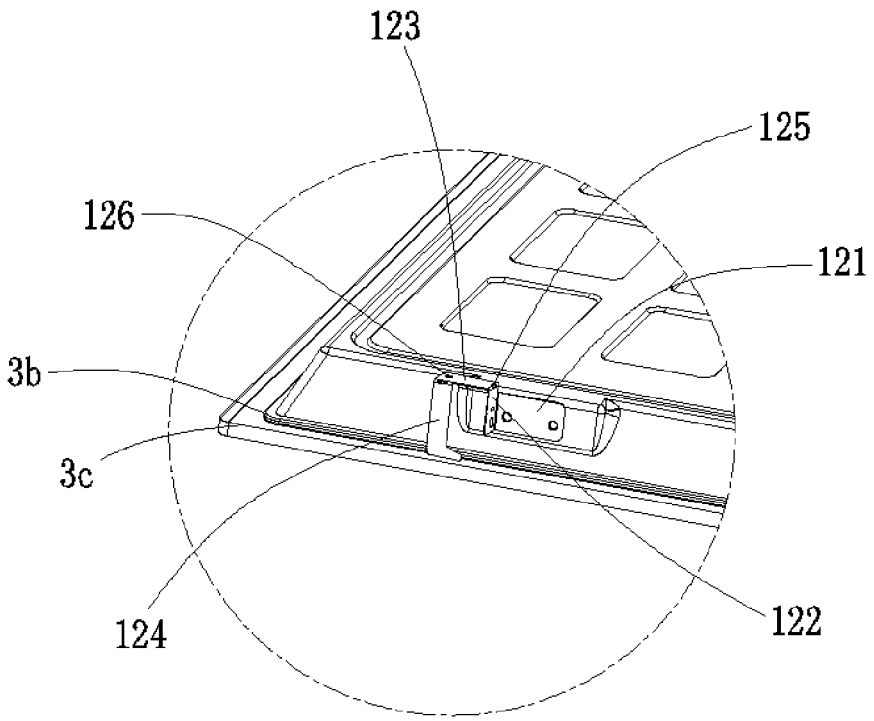
FIG. 4 is an enlarged view of the portion B shown in FIG. 3.
Figure 5:
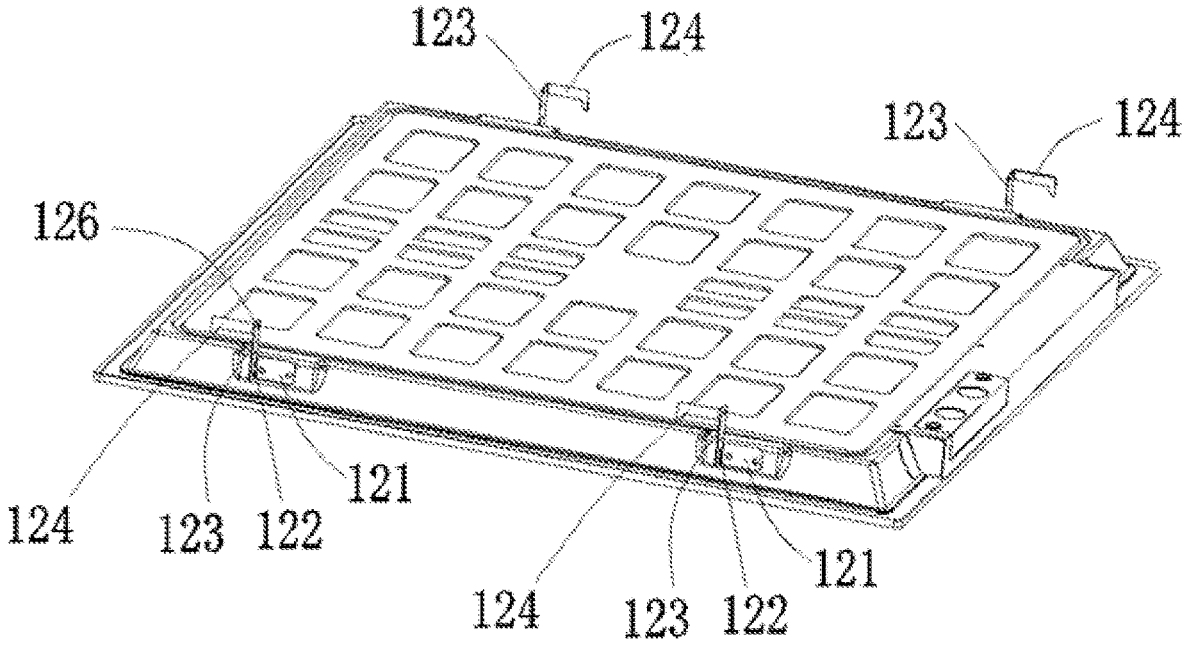
FIG. 5 is a schematic view of the panel lamp of FIG. 2 in a first suspension state according to an embodiment of the present disclosure.
Figure 6:
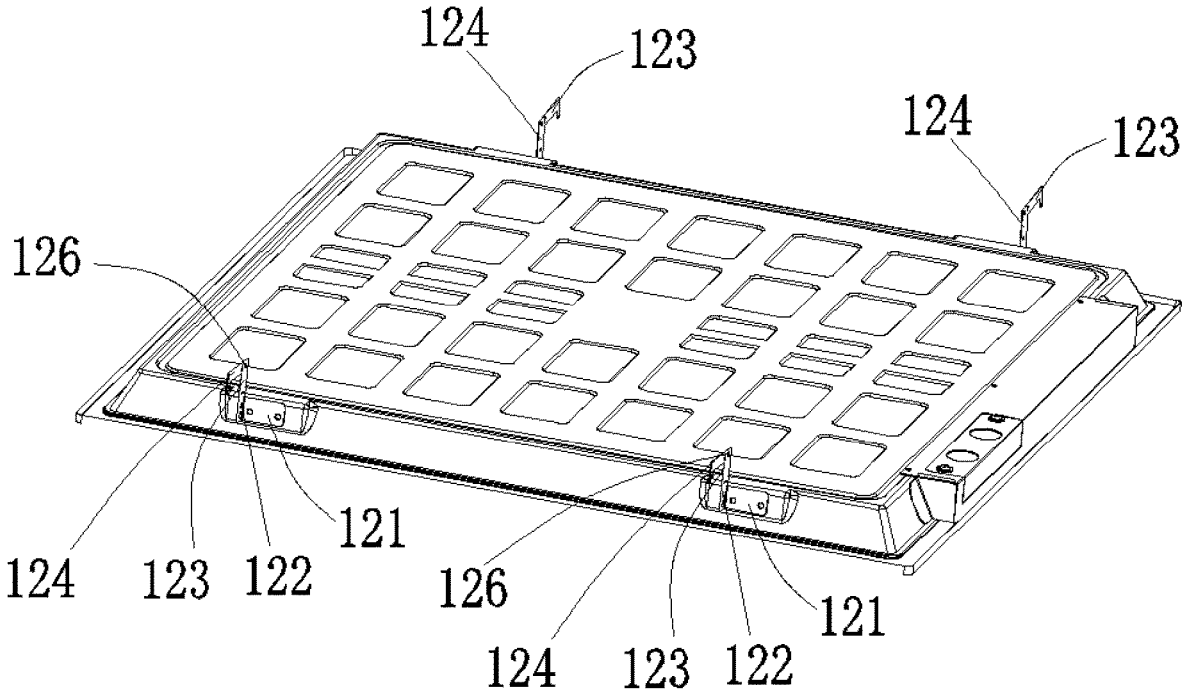
FIG. 6 is a schematic view of the panel lamp of FIG. 2 in a second suspension state according to an embodiment of the present disclosure.

The suspending assembly 12 is deformable, so that the suspending assembly 12 can be hidden at two sides of the bottom case 3. Therefore, the suspending assembly 12 don't occupy space, which is convenient for storage and transportation. In addition, the suspending assembly 12 is protected from being damaged. Referring to FIG. 4, before the panel lamp is mounted onto the top structure, the first connecting plate 121 is connected to the sidewall of the bottom case 3, the second connecting plate 122 is perpendicular to the first connecting plate 121, the third connecting plate 123 is perpendicular to the second connecting plate 122, and the hook 124 is perpendicular to the third connecting plate 123 with an end of the hook facing down. The suspending assemblies 12 can be bended to a suspending state where the panel lamp can be mounted onto the top structure. Referring to FIG. 5, the first connecting plate 121 is connected to the sidewall of the bottom case, the second connecting plate 122 is perpendicular to the first connecting plate 121, the hook 124 is perpendicular to the third connecting plate 122, and the third connecting plate 123 is bended to be in the same plane with the second connecting plate 122. At this state, the hook 24 can be engaged with a slot in the top structure to hang the panel lamp onto the top structure. In at least one embodiment, referring to FIG. 6, the hook 124 can be bended to suit a slot with different shape or size or configuration. Therefore, a shape or configuration or position of the suspending assembly 12 can be adjusted according to actual requirements, which make the suspending assembly more universal. The panel lamp can be easily hung onto the top structure by engaging the hook 124 with the slot in the top structure, which is easy to operate.

In at least one embodiment, the third connecting plate 123 defines a threading hole 126. The threading hole 126 is configured to allow a safe rope passing therethrough to enhance a connection between the suspending assembly 12 and the top structure, which can make the connection between the suspending assembly 12 and the top structure more stable, especially in a special state, such as earthquake.

In at least one embodiment, referring to FIG. 3, the bottom case 3 defines a first through hole 30 configured to allow wires connecting the lighting assembly 2 to pass therethrough to connected to a power source in the top structure. A cover plate 4 is moveably connected to the bottom case to cover the through hole 30. The cover plate 4 can be pushed to move to a first position where the first through hole 30 is exposed and a second position where the first through hole 30 is covered by the cover plate 4. The cover plate 4 defines a second through hole 41. At the first position, the first through hole 30 is exposed to allow the wires connecting the lighting assembly 2 to pass therethrough and extend out of the bottom case 3. The wires connecting the lighting assembly 2 then can pass through the second through hole 41 and the cover plate 4 can be pushed to the second position to cover the first through hole. When the panel lamp is mounted to the top structure, the wires connecting the lighting assembly 2 can be to connected to the power source in the top structure. A size of the second through hole 41 is less than that of the first through hole 30, which help to position the wires and prevent dust from going into the bottom case 3.

In at least one embodiment, the panel lamp can be mounted onto the top structure with a backwall of the bottom case 3. In detail, referring to FIGS. 7-9, the panel lamp further includes four slot assemblies 80, a suspending structure 6, and a mounting bracket 7. The slot assemblies 80 are defined at a back side of the bottom case 3. The suspending structure 6 is configured to be rotatably connected to the bottom case 3. The suspending structure 6 can rotate to a first angle relative to the bottom case 3 where the suspending structure 6 can be used to hang onto the mounting bracket 7 and a second angle where the suspending structure 6 can be attached onto the backwall of the bottom case 3.

Figure 8:
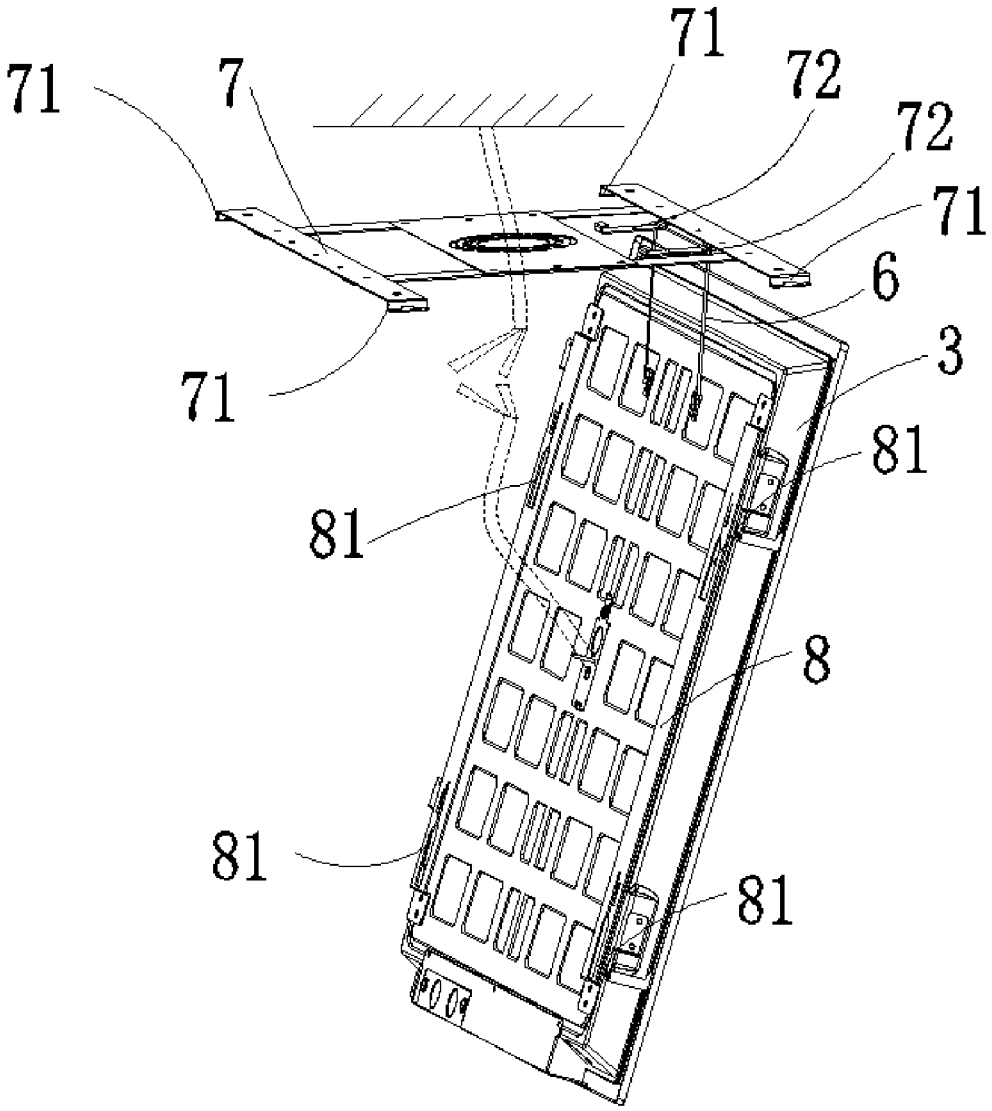
FIG. 8 is a schematic view of the panel lamp of FIG. 2 suspended from an overhead structure according to an embodiment of the present disclosure.

In at least one embodiment, referring to FIG. 8, each slot assembly 80 can include a first slot 81, a second slot 82 communicated with the first slot 81, and a third slot 83. In at least one embodiment, two fixing plates 8 are connected at two opposite sides of a backwall of the bottom case 3. The slot assemblies 80 can be defined at the fixing plates 8. A width of the first slot 81 is greater than that of the second slot 82.

Figure 7:
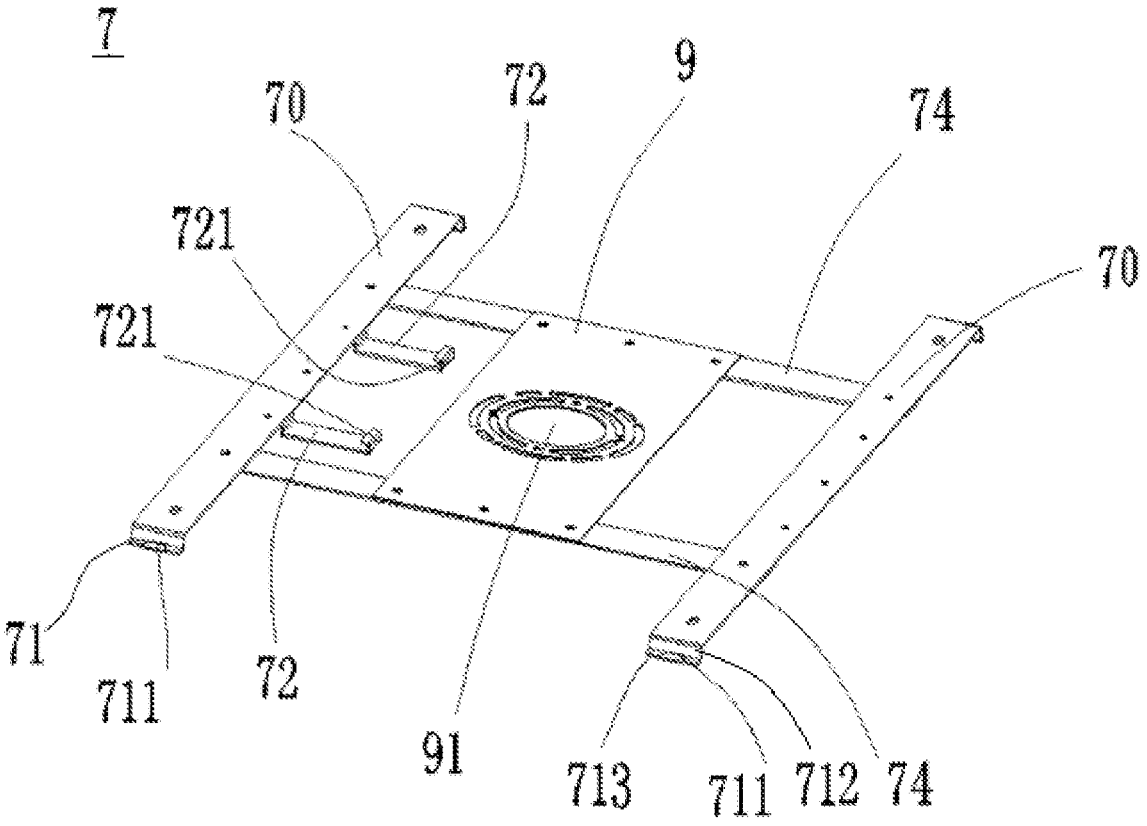
FIG. 7 is a schematic view of a mounting bracket of the panel lamp of FIG. 2 according to an embodiment of the present disclosure.

Referring to FIG. 7, the mounting bracket 7 includes two mounting plates 70 arranged in parallel. Two mounting parts 71 are arranged at two opposite sides of each mounting plate 70 and each mounting part 71 is provided with a clamping member 711. Each mounting part 71 includes a first plate 712 extending from an end of the mounting plate 70, a second plate 713 extending from the first plate 712, and the clamping member 711 extending from the second plate 713. The clamping member 711 is configured to match with the third slot 83 and can be received into the third slot 83. The mounting part 71 can move from the first slot 81 to the second slot 82 until the clamping member 711 can enter the third slot 83 to mount the panel lamp onto the top structure.

Through the slot assembly and the mounting bracket 7, the panel lamp can be easily mounted onto the top structure by pushing the bottom case 3 along the first slot 81 and the second slot 82. It is easy to operate and a connection between the panel lamp and the top structure is stable.

In at least one embodiment, two connecting plates 74 are connected in parallel between the two mounting plates 70. The two mounting plates 70 together with the two connecting plates 74 to form a rectangular frame, which can enhance stability of the two mounting plates 70 and keep the two mounting plates 70 in place. The rectangular structure of the mounting bracket 7 is benefit for mounting large or heavy lamps. In at least one embodiment, the mounting bracket 7 is arranged at the back side of the bottom case and can be hidden by the bottom case 3 when the panel lamp is mounted onto the top structure, which make the panel lamp more beautiful.

In at least one embodiment, a fixing plate 9 is connected between the two connecting plates 74. The fixing plate 9 defines a third through hole 91 which is configured to allow the wires connecting the lighting assembly to pass therethrough to connect a power source in the top structure. The fixing plate 9 can further enhance the structure of the rectangular frame.

In at least one embodiment, the suspending structure 6 is configured to hang the bottom case 3 onto the mounting bracket 7, which facilitate connecting wires connecting the lighting assembly 2 to the power source in the top structure. The suspending structure 6 is a U-shaped ring. Two distal ends of the suspending structure 6 are connected to the bottom case 3 through two fastening elements 5 respectively. In at least one embodiment, the fastening element 5 can include a fastening part 50 and two fixing part 52 arranged at two opposite ends of the fastening part 50. The fixing parts 52 can be connected to the bottom case 3 through fixing elements like screws. Referring to FIG. 3, the fastening part 50 defines a limiting hole 500 which allows the two distal ends of the suspending structure 6 to pass therethrough. The mounting bracket 7 further includes two guiding plates 72 extending from one of the two mounting plates 70 in parallel. The two distal ends of the suspending structure 6 are rotatably received in the limiting hole 500, and the other end of the suspending structure 6 can move along the guiding plates 72. Each guiding plate 72 is provided with a blocking part 721. The blocking part 721 is configured to prevent the suspending structure 6 from moving away from the mounting bracket 7.

Figure 9:
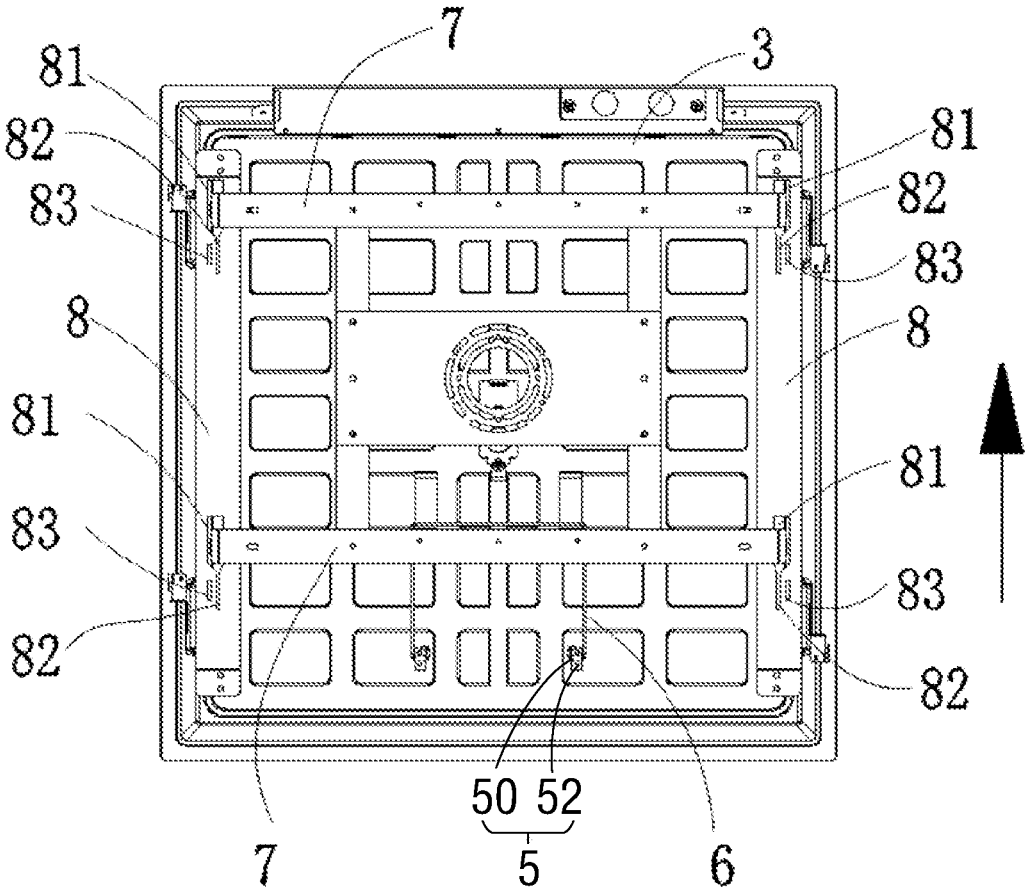
FIG. 9 is a top view of the panel lamp of FIG. 2 in the first state according to an embodiment of the present disclosure.
Figure 10:
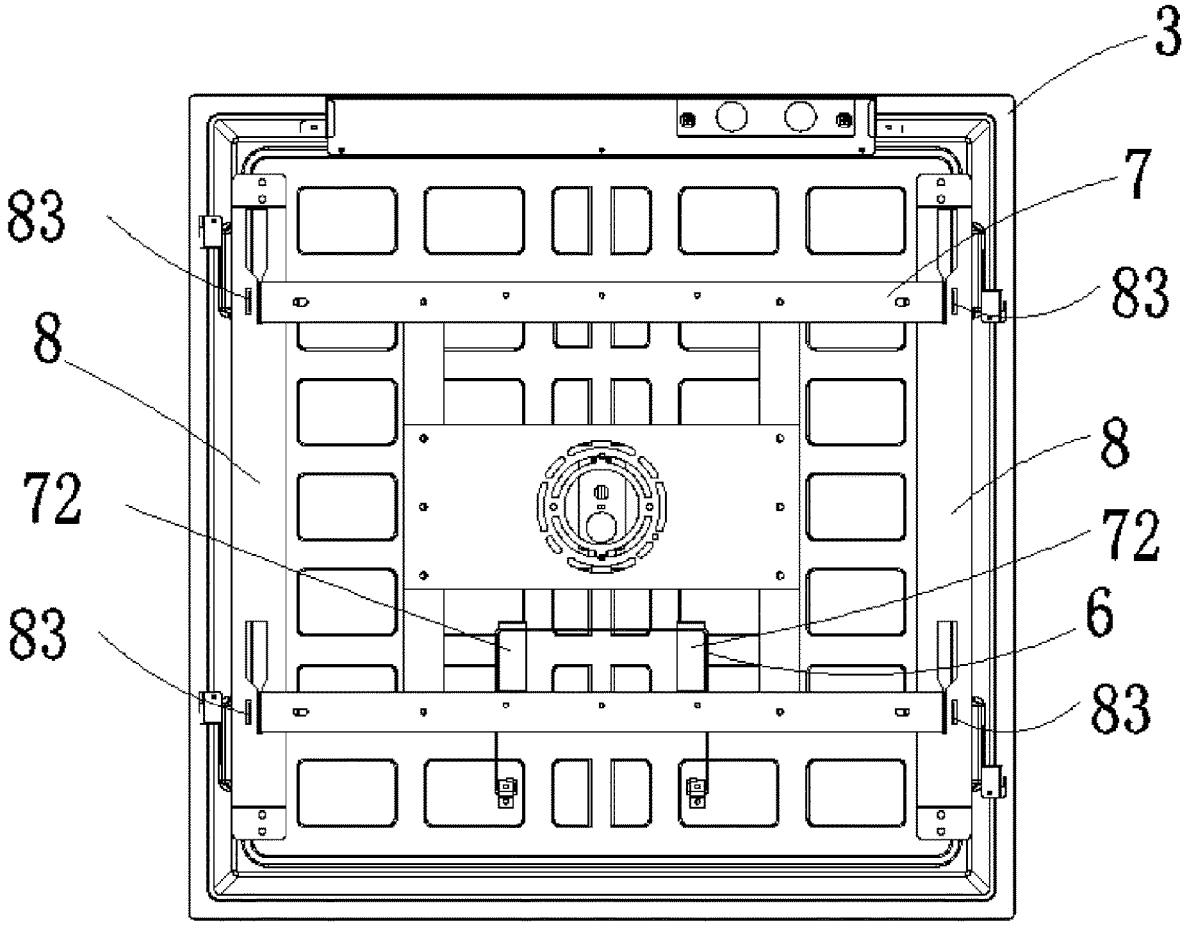
FIG. 10 is a bottom view of the panel lamp of FIG. 2 in a second state according to an embodiment of the present disclosure.
Figure 11:
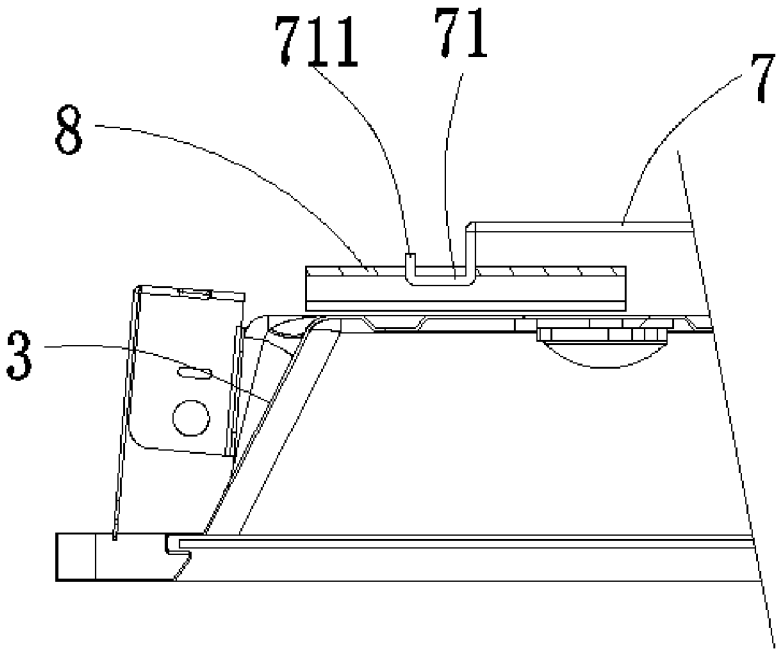
FIG. 11 is a partial cross-sectional view of the panel lamp of FIG. 2 in the second state according to an embodiment of the present disclosure.

Referring to FIGS. 9-11, the mounting process can include: mounting the mounting bracket 7 onto the top structure by fixing elements lick screws; hanging the other end of the suspending structure onto the guiding plates 72 to hang the bottom case 3 onto the mounting bracket 7; connecting wires connecting the lighting assembly 2 to the power source in the top structure; pushing the bottom case 3 along a direction perpendicular to the top structure until each mounting part 71 enters corresponding first slot 81; pushing the bottom case 3 along a length direction of the first slot 81 (for example, along a direction indicated by the arrow shown in FIG. 9) to move the mounting part 71 into the second slot 82. At this time, releasing the bottom case 3, each clamping member 711 enters corresponding third slot 83 under a gravity thereof, therefore, the bottom case 3 cannot move relative to the mounting bracket 7 and the panel lamp is stably mounted onto the top structure.

The panel lamp provided by the present disclosure is simple in structure, and easy to operate. Mounting the panel lamp onto the top structure can be easily finished by a user himself without other's help. It greatly improves the user's experience.

The above description only describes embodiments of the present disclosure, and is not intended to limit the present disclosure, various modifications and changes can be made to the present disclosure. Any modifications, equivalent substitutions, improvements, etc. made within the spirit and scope of the present disclosure are intended to be included within the scope of the present disclosure.

What is claimed is:

1. A panel lamp, comprising:

a bottom case;

a lamp cover;

a lighting assembly arranged between the bottom case and the lamp cover, wherein the bottom case defines a mounting groove, an edge of the lamp cover is configured to be received into the mounting groove; and at least two bendable suspending assemblies arranged at two opposite sides of the bottom case and configured to hang the bottom case onto a top structure; wherein the suspending assembly comprises a first connecting plate connected to the bottom case, a second connecting plate connected to the first connecting plate, and a third connecting plate rotatably connected to the second connecting plate;

wherein the third connecting plate defines a threading hole which is configured to allow a safe rope to pass therethrough.

2. The panel lamp according to claim 1, wherein a flange extends from a sidewall of the bottom case and the mounting groove is defined in the flange, the lamp cover is capable of being pushed into the mounting groove under an external force applied thereon.

3. The panel lamp according to claim 2, wherein a turned edge extends from the sidewall of the bottom case and a height of the turned edge is not less than that of the flange.

4. The panel lamp according to claim 1, wherein the suspending assembly further comprises a hook connected to the third connecting plate.

5. The panel lamp according to claim 4, wherein the suspending assembly is integrally formed by bendable metal.

6. The panel lamp according to claim 5, wherein the suspending assembly is capable of being switched between a suspending state where the suspending assembly is capable of being suspended onto the top structure and a folding state where the suspending assembly is attached to a sidewall of the bottom case.

7. The panel lamp according to claim 6, wherein the second connecting plate is substantially perpendicular to the first connecting plate, the hook is substantially perpendicular to the third connecting plate, and the third connecting plate is rotatably connected to the second connecting plate, when the third connecting plate is rotated to be in the same plane with the second connecting plate the suspending assembly is in the suspending state, and when the third connecting plate is rotated to be substantially perpendicular to the second connecting plate the suspending assembly is in the folded state.

8. The panel lamp according to claim 4, wherein a portion of the first connecting plate where the second connecting plate is connected to, a portion of the second connecting plate where the third connecting plate is connected to, and a portion of the third connecting plate where the hook is connected to are bendable.

9. The panel lamp according to claim 4, wherein a portion of the first connecting plate where the second connecting plate is connected to, a portion of the second connecting plate where the third connecting plate is connected to, and a portion of the third connecting plate where the hook is connected to are in a hollowed-out structure.

10. The panel lamp according to claim 1, wherein the number of the at least two suspending assemblies is four, four suspending assemblies are symmetrically arranged at two opposite sides of the bottom case.

11. The panel lamp according to claim 1, wherein the bottom case defines a first through hole at a backwall of the bottom case, the first through hole is configured to allow wires connecting the lighting assembly to pass therethrough to connect a power source in the top structure.

12. The panel lamp according to claim 11, wherein a cover plate is moveably connected to the bottom case and configured to cover the first through hole, the cover plate defines a second through hole which is configured to allow the wires connecting the lighting assembly to pass therethrough to connect the power source in the top structure, a size of the second through hole is less than that of the first through hole.

13. The panel lamp according to claim 1, further comprising a slot assembly defined at a back side of the bottom case and a mounting bracket, the slot assembly comprises a first slot, a second slot communicating with the first slot, and a third slot near the second slot, the mounting bracket comprises at least one mounting plate, two mounting parts are arranged at two opposite sides of each mounting plate 70 and each mounting part is provided with a clamping member 711, the mounting part 70 is capable of moving along the first slot and moving from the first slot to the second slot until the clamping member 711 enters the third slot.

14. The panel lamp according to claim 13, wherein the number of the at least one mounting plate is two, the mounting bracket further comprises two connecting plates, and two connecting plates together with the two mounting plates to form a rectangular frame.

15. The panel lamp according to claim 14, wherein a fixing plate is connected between the two connecting plates, the fixing plate defines a third through hole which is configured to allow the wires connecting the lighting assembly to pass therethrough to connect a power source in the top structure.

16. The panel lamp according to claim 15, further comprising a suspending structure, one end of the suspending structure is rotatably connected to the bottom case, and the other end of the suspending structure is capable of being hung from the mounting bracket.

17. The panel lamp according to claim 16, wherein the mounting bracket comprises at least one guiding plate which extends from one of the two mounting plates towards the fixing plate, the suspending structure is configured to move along the guiding plate, the guiding plate is provided with a blocking part which is configured to prevent the suspending structure from moving away from the guiding plate.

18. The panel lamp according to claim 16, wherein the suspending structure is U-shaped, two distal ends of the suspending structure are connected to the bottom case through two fastening elements respectively.

19. The panel lamp according to claim 1, wherein each fastening element comprises a fastening part and two fixing part arranged at two opposite ends of the fastening part, the fixing parts are connected to the bottom case, the fastening part defines a limiting hole which allows the distal ends of the suspending structure to pass therethrough.

* * * * *